US009156578B2

(12) United States Patent
Smith

(10) Patent No.: US 9,156,578 B2
(45) Date of Patent: Oct. 13, 2015

(54) REINFORCED POLYGONAL CONTAINERS AND BLANKS FOR MAKING THE SAME

(71) Applicant: Rock-Tenn Shared Services, LLC, Norcross, GA (US)

(72) Inventor: Kenneth Charles Smith, Hiram, GA (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 203 days.

(21) Appl. No.: 13/755,183

(22) Filed: Jan. 31, 2013

(65) Prior Publication Data

US 2013/0200137 A1 Aug. 8, 2013

Related U.S. Application Data

(60) Provisional application No. 61/594,874, filed on Feb. 3, 2012.

(51) Int. Cl.

| | |
|---|---|
| ***B65D 1/22*** | (2006.01) |
| ***B31B 3/28*** | (2006.01) |
| ***B65D 5/00*** | (2006.01) |
| ***B65D 5/44*** | (2006.01) |

(52) U.S. Cl.

CPC . *B65D 1/225* (2013.01); *B31B 3/28* (2013.01); *B65D 5/0015* (2013.01); *B65D 5/443* (2013.01)

(58) Field of Classification Search

USPC ..... 229/919, 174, 177, 916, 920

See application file for complete search history.

(56) References Cited

U.S. PATENT DOCUMENTS

| | | | | |
|---|---|---|---|---|
| 2,965,279 | A * | 12/1960 | Campbell | 206/509 |
| 3,118,591 | A * | 1/1964 | Allard | 229/161 |
| 4,676,429 | A | 6/1987 | Crowe et al. | |
| 4,792,084 | A | 12/1988 | Dreeszen | |
| 5,125,568 | A | 6/1992 | Bauer | |
| 5,203,494 | A | 4/1993 | Blomfield | |
| 5,285,956 | A | 2/1994 | Piepho | |
| 5,361,976 | A | 11/1994 | Blomfield | |
| 5,429,296 | A | 7/1995 | Southwell et al. | |
| 5,452,848 | A | 9/1995 | Mur Gimeno | |
| 5,458,283 | A | 10/1995 | Southwell et al. | |
| 5,516,034 | A | 5/1996 | Jensen et al. | |
| 5,535,941 | A | 7/1996 | Garza | |
| 5,649,663 | A | 7/1997 | Pestow | |
| 5,673,848 | A | 10/1997 | Garza | |
| 5,839,650 | A | 11/1998 | Sheffer | |

(Continued)

OTHER PUBLICATIONS

International Search Report, Application No. PCT/us2013/024112, dated Mar. 22, 2013, pp. 9.

*Primary Examiner* — Christopher Demeree

(74) *Attorney, Agent, or Firm* — Armstrong Teasdale LLP

(57) ABSTRACT

A blank of sheet material for forming a polygonal container is provided. The blank includes a bottom panel, two opposing end panels each extending from an end edge of the bottom panel, two opposing outer side panels each extending from a side edge of the bottom panel, and an inner side panel extending from each top edge of one outer side panel of the two outer side panels. Each inner side panel includes a central portion, a corner portion extending from each side of the central portion, an inner end portion extending from each side of one of the corner portions, and a plurality of elongated relief cutouts. One elongated relief cutout of the plurality of elongated relief cutouts is defined between each corner portion and the central portion and between each inner end portion and an adjacent corner portion.

21 Claims, 15 Drawing Sheets

(56) References Cited

U.S. PATENT DOCUMENTS

| | | | |
|---|---|---|---|
| 5,860,590 | A | 1/1999 | Blomfield et al. |
| 6,098,873 | A | 8/2000 | Sheffer |
| 6,131,805 | A | 10/2000 | Gasior |
| 6,158,652 | A | 12/2000 | Ruiz et al. |
| 6,270,009 | B1 | 8/2001 | Heeren |
| 6,286,753 | B1 | 9/2001 | Jackson et al. |
| 6,296,178 | B1 | 10/2001 | McKenna |
| 6,302,323 | B1 | 10/2001 | Southwell |
| 6,375,068 | B2 | 4/2002 | Jackson et al. |
| 6,443,358 | B1 | 9/2002 | Schilling |
| 6,460,758 | B1 | 10/2002 | Fenton et al. |
| 6,464,131 | B1 | 10/2002 | Blazevich |
| 6,481,619 | B1 | 11/2002 | Jackson |
| 6,502,698 | B1 | 1/2003 | McKenna et al. |
| 6,508,395 | B2 | 1/2003 | McLeod |
| 6,568,588 | B2 | 5/2003 | Holdsworth et al. |
| 6,575,356 | B2 | 6/2003 | McClure |
| 6,581,772 | B2 | 6/2003 | Noland |
| 6,598,785 | B2 | 7/2003 | Quaintance |
| 6,604,675 | B2 | 8/2003 | Southwell |
| 6,641,032 | B1 | 11/2003 | Schilling |
| 6,676,012 | B1 | 1/2004 | Southwell et al. |
| 6,719,191 | B1 | 4/2004 | Christensen et al. |
| 6,889,893 | B2 | 5/2005 | Kent |
| 6,899,266 | B2 | 5/2005 | Conway |
| 7,081,077 | B2 | 7/2006 | Southwell et al. |
| 7,124,890 | B2 | 10/2006 | McLeod et al. |
| 7,207,473 | B2 | 4/2007 | Fry |
| 7,467,743 | B1 | 12/2008 | Philips |
| 7,485,083 | B2 | 2/2009 | Gaeta et al. |
| 7,628,313 | B2 | 12/2009 | Fry |
| 7,635,080 | B2 | 12/2009 | Conway |
| 7,677,434 | B2 | 3/2010 | Fry |
| 7,681,785 | B2 | 3/2010 | Grigor |
| 7,740,164 | B2 | 6/2010 | McClure |
| 8,011,565 | B2 | 9/2011 | Quaintance et al. |
| 8,070,053 | B2 | 12/2011 | Fry |
| 8,079,474 | B1 | 12/2011 | Flaming |
| 8,087,569 | B2 | 1/2012 | Ledvina |
| 8,105,223 | B2 | 1/2012 | Graham et al. |
| 8,205,787 | B2 | 6/2012 | Panduro et al. |
| 2003/0146272 | A1 | 8/2003 | Kent |
| 2004/0256448 | A1 | 12/2004 | Blomfield et al. |
| 2006/0278691 | A1 | 12/2006 | Bezek |
| 2009/0272789 | A1 | 11/2009 | Fry |
| 2012/0000973 | A1 | 1/2012 | McLeod |

* cited by examiner

REINFORCED POLYGONAL CONTAINERS AND BLANKS FOR MAKING THE SAME

CROSS REFERENCE TO RELATED APPLICATIONS

This application claims priority to U.S. Provisional Application No. 61/594,874 filed Feb. 3, 2012, which is hereby incorporated by reference in its entirety.

BACKGROUND OF THE INVENTION

The embodiments described herein relate generally to blanks for forming polygonal containers and, more particularly, to blanks for forming polygonal containers with reinforced corner, end, and side walls.

Containers are frequently utilized to store and aid in transporting products. These containers can be square, hexagonal, or octagonal. The shape of the container can provide additional strength to the container. For example, octagonal-shaped containers provide greater resistance to bulge over conventional rectangular, square or even hexagonal-shaped containers. An octagonal-shaped container may also provide increased stacking strength.

In at least some known cases, a blank of sheet material is used to form a container for transporting a product. More specifically, these known containers are formed by a machine that folds a plurality of panels along fold lines and secures these panels with an adhesive. Such containers may have certain strength requirements for transporting products. These strength requirements may include a stacking strength requirement such that the containers can be stacked on one another during transport without collapsing. To meet these strength requirements, at least some known containers include reinforced corners or side walls for providing additional strength including stacking strength. In at least some known embodiments, additional panels may be placed in a face-to-face relationship with another corner panel or side wall. However, at least some of the fold lines connecting the reinforcing panels in known containers are not at a right angle to a bottom panel. As such, a stacking strength of the container may be reduced.

BRIEF DESCRIPTION OF THE INVENTION

In one aspect, a blank of sheet material for forming a polygonal container is provided. The blank includes a bottom panel, two opposing end panels each extending from an end edge of the bottom panel, two opposing outer side panels each extending from a side edge of the bottom panel, and an inner side panel extending from each top edge of one outer side panel of the two outer side panels. Each inner side panel includes a central portion, a corner portion extending from each side of the central portion, an inner end portion extending from each side of one of the corner portions, and a plurality of elongated relief cutouts. One elongated relief cutout of the plurality of elongated relief cutouts is defined between each corner portion and the central portion and between each inner end portion and an adjacent corner portion.

In another aspect, a container formed from a blank of sheet material is provided. The container includes a bottom wall, a pair of opposing end walls coupled to the bottom wall, and a pair of opposing side walls coupled to the bottom wall, four corner walls, one corner wall of the four corner walls coupled between each end wall and each side wall, and a plurality of elongated relief cutouts, one elongated relief cutout of the plurality of elongated relief cutouts defined between each corner wall and each end wall and between each corner wall and each side wall.

In yet another aspect, a method of forming a container from a blank of sheet material is provided. The blank includes a bottom panel, two opposing end panels, each end panel extending from an end edge of the bottom panel, two opposing outer side panels, each outer side panel extending from a side edge of the bottom panel, an inner side panel extending from each top edge of one outer side panel of the two outer side panels, each inner side panel including a central portion, a corner portion extending from each side of the central portion, an inner end portion extending from each side of one of the corner portions, and a plurality of elongated relief cutouts, one elongated relief cutout of the plurality of elongated relief cutouts defined between each corner portion and the central portion and between each inner end portion and an adjacent corner portion. The blank further includes a corner panel extending from each side edge of one of the outer side panels along a first fold line, the corner panel generally aligned with one of the corner portions, and an inner end panel extending from one of the corner panels along a second fold line, the inner end panel generally aligned with one of the inner end portions, the first fold line and the second fold line substantially perpendicular to a fold line between the bottom panel and a respective outer side panel. The method includes rotating the outer side panels towards the bottom panel such that the outer side panels are substantially perpendicular to the bottom panel, rotating the inner side panels towards the bottom panel such that the inner side panels are substantially parallel to the outer side panels, wherein the central portions of each inner side panel and the outer side panels form a pair of opposing side walls, rotating the corner panels along the first fold lines and rotating the corner portions of the inner side panels at elongated relief cutouts aligned with the first fold lines to form four corner walls, rotating the inner end panels along the second fold lines and rotating the inner end portions at elongated relief cutouts aligned with the second fold lines, rotating the end panels toward the bottom panel such that the end panels are substantially perpendicular to the bottom panel, and coupling the end panels to respective inner end panels to form a pair of opposing end walls.

BRIEF DESCRIPTION OF THE DRAWINGS

FIGS. 1-11 show exemplary embodiments of the blanks and containers described herein.

FIG. 1 is a top plan view of an exemplary blank of sheet material for forming a container.

FIG. 2 is a perspective view of an exemplary container formed from the blank shown in FIG. 1.

FIG. 3 is a perspective view of a stack of containers shown in FIG. 2.

FIG. 4 is a top plan view of a first alternative blank of sheet material for forming a container.

FIG. 7 is a perspective view of an exemplary container formed from the blank shown in FIG. 6A.

FIG. 9 is a perspective view of an exemplary container formed from the blank shown in FIG. 8A.

FIG. 11 is a perspective view of an exemplary container formed from the blank shown in FIG. 10A.

DETAILED DESCRIPTION OF THE INVENTION

The embodiments described herein provide a stackable, reinforced container formed from a single sheet of material and a method for constructing the container. The container is sometimes referred to as a reinforced mitered tray or a reinforced eight-sided container. The container may be constructed from a blank of sheet material using at least one machine.

In one embodiment, the blanks are fabricated from a cardboard material. The blanks, however, may be fabricated using any suitable material, and therefore are not limited to a specific type of material. In alternative embodiments, the blanks are fabricated using cardboard, plastic, fiberboard, paperboard, foamboard, corrugated paper, and/or any suitable material known to those skilled in the art and guided by the teachings herein provided. The container may have any suitable size, shape, and/or configuration, whether such sizes, shapes, and/or configurations are described and/or illustrated herein. Further, different embodiments described here can vary in size and/or dimensions although similar labels are used for each embodiment. For example, although a depth is labeled similarly throughout the description, each embodiment can have varying depths.

In an example embodiment, the container includes at least one marking thereon including, without limitation, indicia that communicates the product stored in the tray, a manufacturer of the product, and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the container is void of markings, such as, without limitation, indicia that communicates the product, a manufacturer of the product and/or a seller of the product.

The following detailed description illustrates the disclosure by way of example and not by way of limitation. The description clearly enables one skilled in the art to make and use an exemplary container, describes several embodiments, adaptations, variations, alternatives, and use of the blanks and/or containers, including what is presently believed to be the best mode of carrying out the disclosure.

Figure 1:
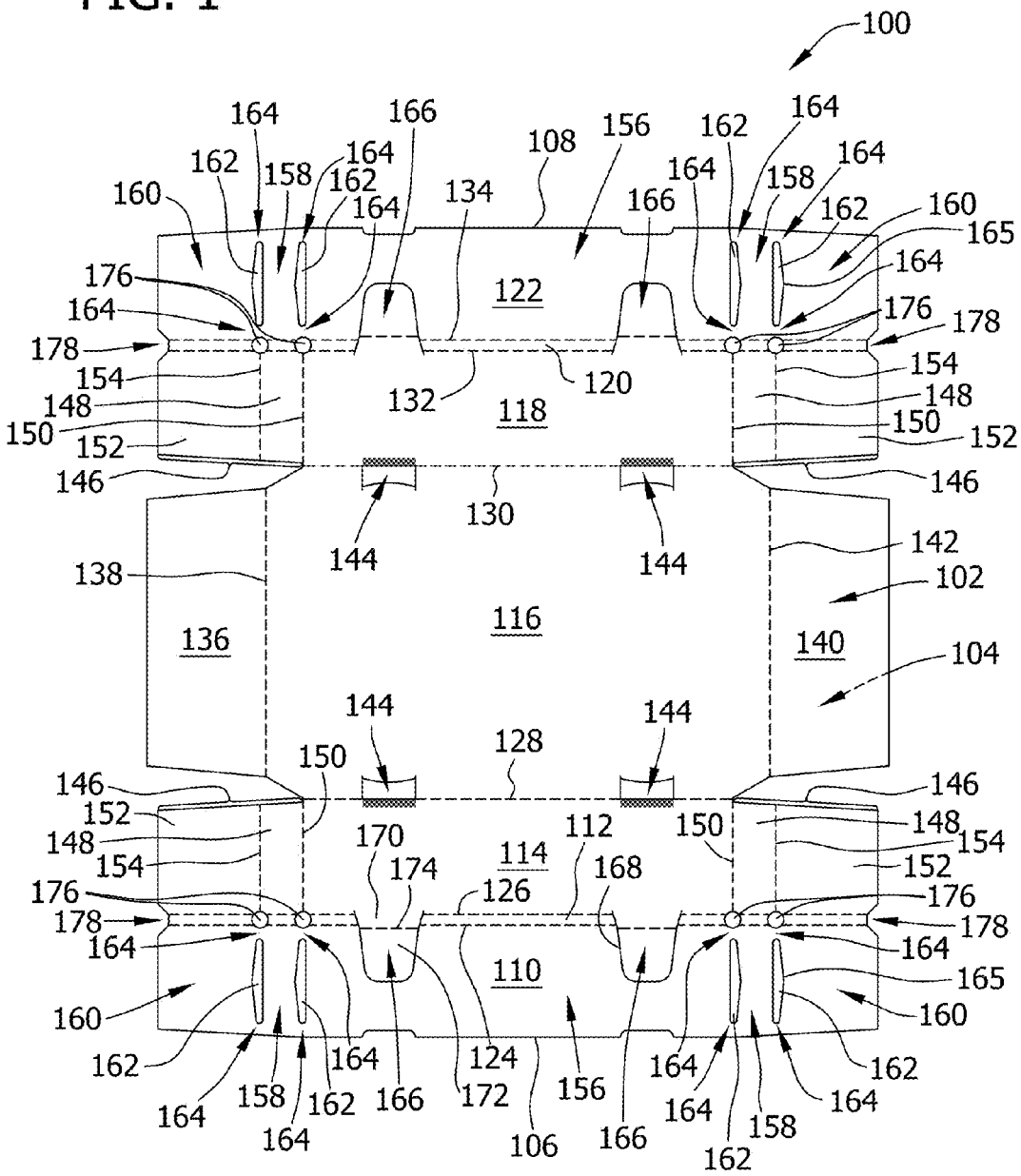
Figure 2:
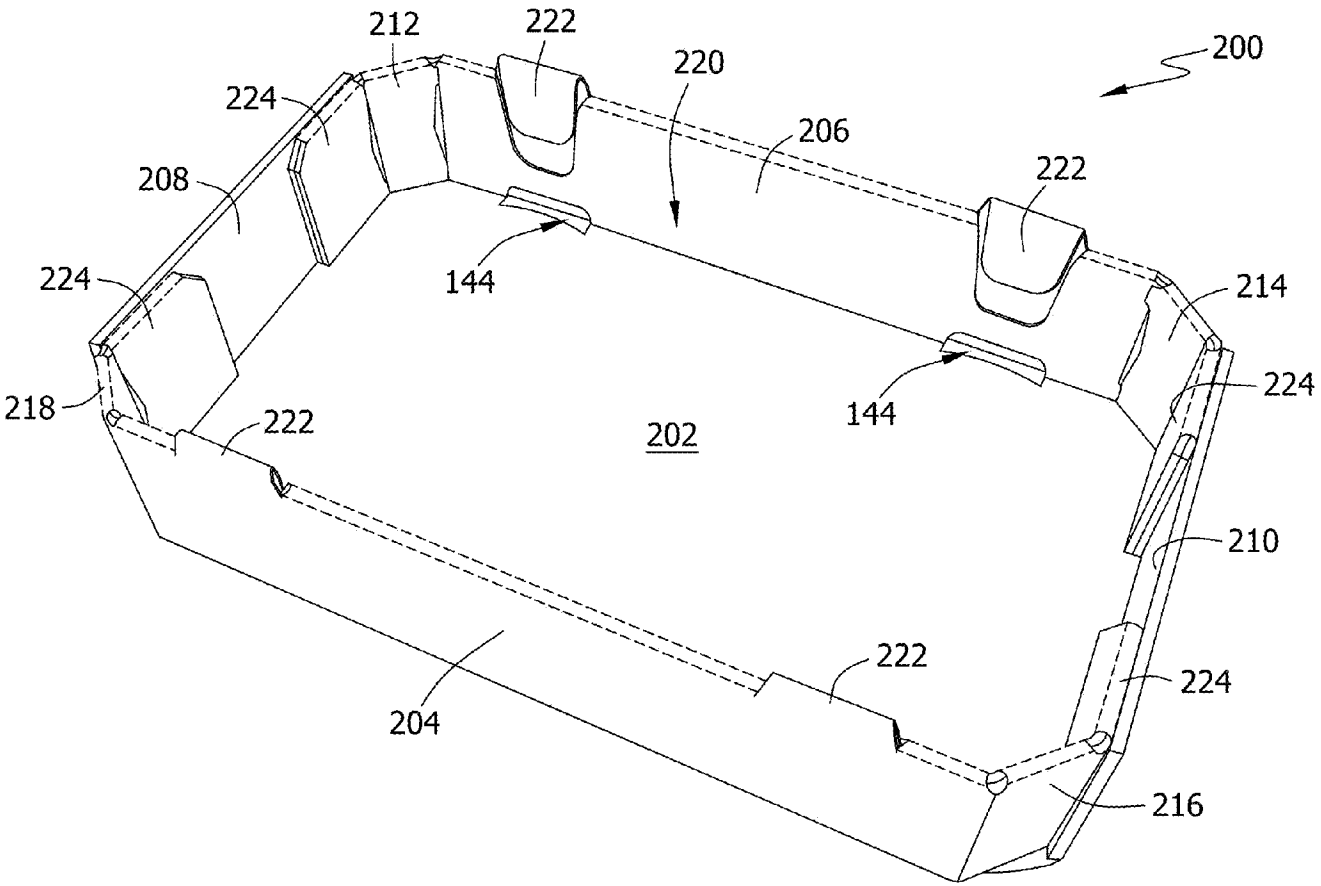
Figure 3:
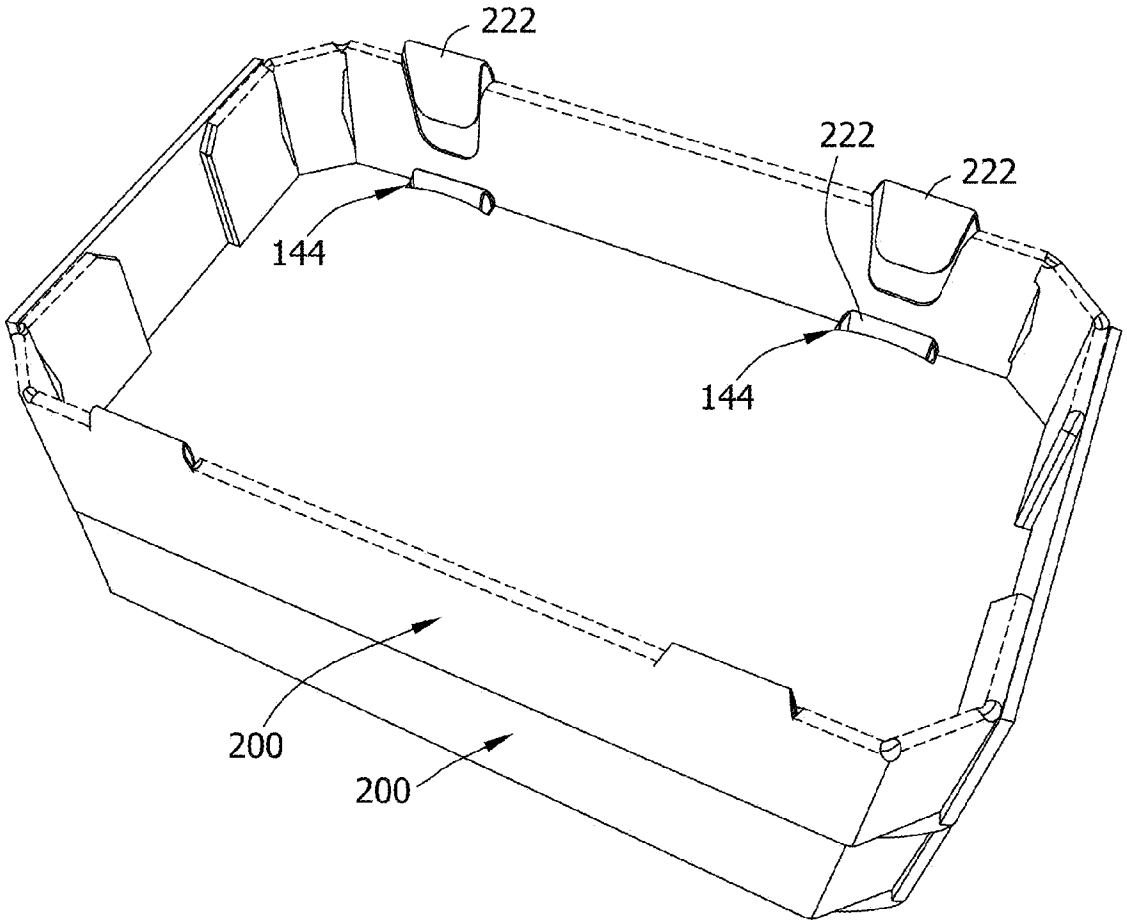

Referring now to the drawings, FIG. 1 is a top plan view of an exemplary blank 100 of sheet material for forming a container 200 (shown in FIGS. 2 and 3). Blank 100 has a first or interior surface 102 and an opposing second or exterior surface 104. Further, blank 100 defines a first edge 106 and an opposing second edge 108. In one embodiment, blank 100 includes, in series from first edge 106 to second edge 108, a first inner side panel 110, a first rollover panel 112, a first outer side panel 114, a bottom panel 116, a second outer side panel 118, a second rollover panel 120, and a second inner side panel 122 coupled together along preformed, generally parallel, fold lines 124, 126, 128, 130, 132, and 134, respectively. Rollover panels 112 and 120 allow for a "true" or "full" rollover.

A first end panel 136 extends from a first end edge of bottom panel 116 along a fold line 138, and an opposing second end panel 140 extends from a second end edge of bottom panel 116 along a fold line 142. In the exemplary embodiment, a pair of slots 144 is defined along each fold line 128 and 130. Slots 144 are configured to receive a tab from a lower container, as described in more detail below.

A panel assembly 146 extends from each side edge of each outer side panel 114 and 118. As such, blank 100 includes four panel assemblies 146. Each panel assembly 146 includes a corner panel 148 extending from a respective outer side panel 114 or 118 at a fold line 150 and an inner end panel 152 extending from a respective corner panel 148 at a fold line 154. Fold lines 150 and 154 are referred to as "miter fold lines". Miter fold lines 150 and 154 are substantially perpendicular to fold lines 124, 126, 128, 130, 132, and 134.

Each inner side panel 110 and 122 includes a central portion 156, a pair of corner portions 158, and a pair of inner end portions 160. Portions 156, 158, and 160 are continuous portions of material not interrupted by any fold lines. In the exemplary embodiment, a corner portion 158 extends from each side of central portion 156, and an inner end portion 160 extends from each side of each corner portion 156.

An elongated relief cutout 162 is defined between central portion 156 and each corner portion 158 and between each corner portion 158 and each inner end portion 160. As such, each inner side panel 110 and 122 includes four elongated relief cutouts 162. A portion 164 of material remains between each relief cutout 162 and fold line 124 or 134 and between each relief cutout 162 and an adjacent edge 106 or 108. Each elongated relief cutout 162 is generally aligned collinearly with a respective miter fold line 150 or 154. In the exemplary embodiment, each elongated relief cutout 162 is generally oblong-shaped with an apex 165 on one side of the oblong, such that relief cutout 162 is substantially "D"-shaped. Apex 165 is located on the side of relief cutout 162 closest to an adjacent inner end portion 160 (i.e., the side furthest from an adjacent central portion 156) in the exemplary embodiment. However, it should be understood that elongated relief cutouts 162 can have any suitable size, shape, and/or configuration that enables blank 100 to function as described herein.

A rollover panel 112 or 120 extends between each corner panel 148 and an adjacent corner portion 158 and between each inner end panel 152 and an adjacent inner end portion 160. A pair of tabs 166 is defined along each rollover panel 112 and 120. More specifically, each tab 166 is defined by a cut line 168 that interrupts fold lines 124 and 126 and fold lines 132 and 134 and extends from an outer side panel 114 or 118 into an adjacent inner side panel 110 or 122. Each tab 166 includes a first portion 170 and a second portion 172 connected by a fold line 174. First portion 170 extends from a respective outer side panel 114 or 118, across rollover panel 112 or 120, into inner side panel 110 or 122. Second portion 172 is defined within a respective inner side panel 110 or 122. In the exemplary embodiment, each tab 166 is aligned with a slot 144.

Further, rollover relief cutouts 176 are defined in each rollover panel 112 and 120. More specifically, a rollover relief cutout 176 is generally aligned between an elongated relief cutout 162 and a respective miter fold line 150 or 154. In the exemplary embodiment, each rollover relief cutout 176 is substantially circular shaped and extends beyond fold lines 124 and 126 or fold lines 132 and 134 into an adjacent panel or portion. However, it should be understood that rollover relief cutouts 176 can have any suitable size, shape, and/or configuration that enables blank 100 to function as described herein. Further, in the exemplary embodiment, relief notches 178 are defined at each rollover panel 112 and 120 such that rollover panels 112 and 120 are narrower than inner side panels 110 and 122 and outer side panels 114 and 118. Cutouts 162 and 176 and notches 178 allow miter fold lines 150 and 154 and cutouts 162 to be substantially perpendicular to fold lines 124, 126, 128, 130, 132, and 134, as opposed to known blanks having miter fold lines that are other than perpendicular to at least a bottom panel of the known blank.

FIG. 2 is a perspective view of an exemplary container 200 formed from blank 100 (shown in FIG. 1). Container 200 includes a bottom wall 202, a first side wall 204, a second side wall 206, a first end wall 208, a second end wall 210, and four corner walls 212, 214, 216, and 218 defining a cavity 220. Slots 144 are defined at least in bottom wall 202.

Referring to FIGS. 1 and 2, to form container 200 from blank 100, rollover panel 112 is rotated about fold line 126 toward interior surface 102 of outer side panel 114, and rollover panel 120 is rotated about fold line 132 toward interior surface 102 of outer side panel 118. Similarly, inner side panel 110 is rotated about fold line 124 toward interior surface 102 of rollover panel 112 until inner side panel 110 is substantially parallel to outer side panel 114, and inner side panel 122 is rotated about fold line 134 toward interior surface 102 of rollover panel 120 until inner side panel 122 is substantially parallel to outer side panel 118. At least interior surfaces 102 of central portions 156 of inner side panels 110 and 122 are coupled to interior surface 102 of a respective outer side panel 114 or 118. First outer side panel 114 and central portion 156 of first inner side panel 110 define first side wall 204, and second outer side panel 118 and central portion 156 of second inner side panel 122 define second side wall 206.

Second portion 172 of each tab 166 is rotated about fold line 174 toward a respective first portion 170, and interior surface 102 of second portions 172 are coupled to interior surface 102 of first portions 170 to form a plurality of stacking tabs 222 extending upward from each side wall 204 and 206.

Each corner panel 148 is in face-to-face relationship with a respective corner portion 158, and each inner end panel 152 is in face-to-face relationship with a respective inner end portion 160. Each corner panel 148 is rotated about a respective fold line 150 toward an adjacent side wall 204 or 206. As such, each corner portion 158 rotates toward an adjacent side wall 204 or 206 at elongated relief cutout 162. When corner portions 158 rotate, portions 164 of material crumple, bend, crush, or otherwise deform to allow corner portions 158 to rotate with respect to central portion 156. Cutouts 162 and/or 176 and/or notches 178 enable portions 164 to deform when corner portions 158 are rotated. Each corner panel 148 and corner portion 158 pair defines a corner wall 212, 214, 216, or 218.

Similarly, each inner end panel 152 is rotated about a respective fold line 154 toward an adjacent corner wall 212, 214, 216, or 218. As such, each inner end portion 160 rotates toward an adjacent corner wall 212, 214, 216, or 218 at elongated relief cutout 162. When inner end portions 160 rotate, portions 164 of material crumple, bend, crush, or otherwise deform to allow inner end portions 160 to rotate with respect to a respective corner portion 158. Cutouts 162 and/or 176 and/or notches 178 enable portions 164 to deform when inner end portions 160 are rotated. Each inner end panel 152 and inner end portion 160 pair defines an inner end assembly 224. Inner end assemblies 224 are substantially perpendicular to side walls 204 and 206.

Each side wall 204 and 206 is rotated about a respective fold line 128 or 130 toward interior surface 102 of bottom wall 202 defined by bottom panel 116. More specifically, side walls 204 and 206 are rotated to be substantially perpendicular to bottom wall 202. As side walls 204 and 206 are rotated, corner walls 212, 214, 216, and 218 and inner end assemblies 224 rotate toward bottom wall 202 to be substantially perpendicular to bottom wall 202.

First end panel 136 is rotated about fold line 138 toward bottom wall 202, and second end panel 140 is rotated about fold line 142 toward bottom wall 202. A pair of inner end assemblies 224 adjacent to first end panel 136 is coupled to interior surface 102 of first end panel 136 to form first end wall 208. Similarly, a pair of inner end assemblies 224 adjacent to second end panel 140 is coupled to interior surface 102 of second end panel 140 to form second end wall 210.

FIG. 3 is a perspective view of a stack of containers 200. When containers 200 are stacked, stacking tabs 222 of a lower container 200 are received within slots 144 of an upper container 200.

Figure 4:
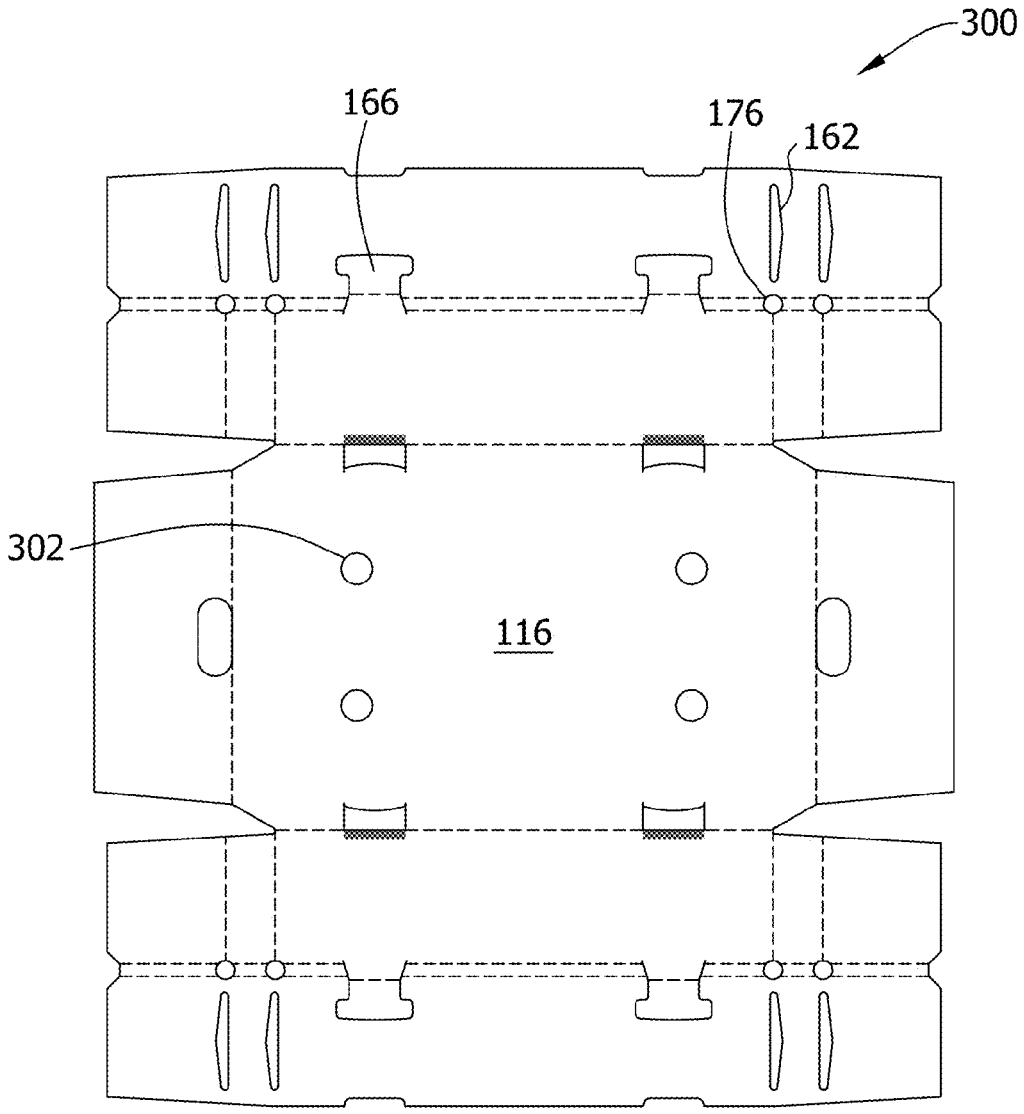

FIG. 4 is a top plan view of a first alternative blank 300 of sheet material for forming a container. Similar to blank 100, blank 300 includes elongated relief cutouts 162 and rollover relief cutouts 176. Unlike blank 100, tabs 166 of blank 300 are substantially "T"-shaped. Further blank 300 includes four circular cutouts 302 defined through bottom panel 116. Otherwise, blank 300 is substantially similar to blank 100.

Figure 5A:
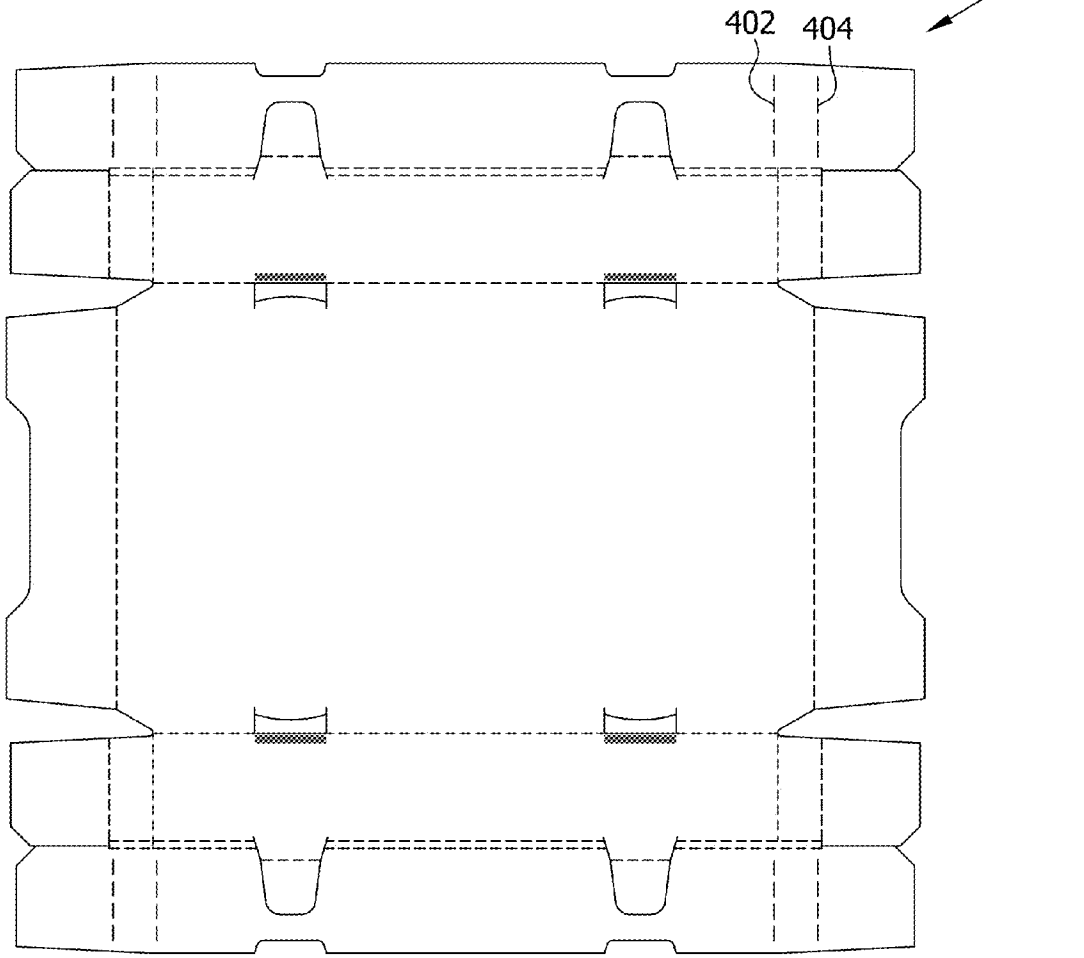
FIG. 5A is a top plan view of a second alternative blank of sheet material for forming a container.
Figure 5B:
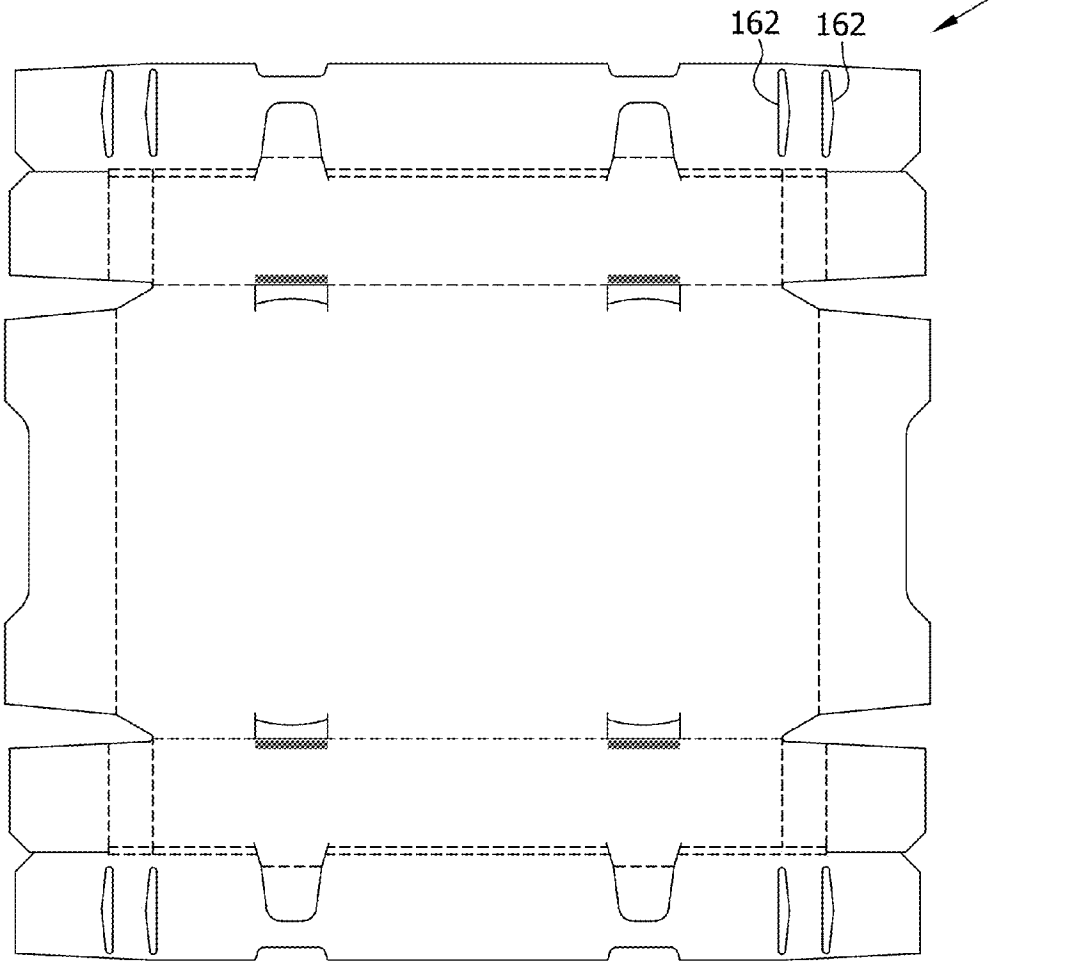
FIG. 5B is a top plan view of a third alternative blank of sheet material for forming a container.

FIG. 5A is a top plan view of a second alternative blank 400 of sheet material for forming a container. Blank 400 includes fold lines 402 and 404. FIG. 5B is a top plan view of a third alternative blank 420 of sheet material for forming a container. Blank 420 is substantially similar to blank 400, except that blank 420 includes elongated relief cutouts 162 instead of fold lines 402 and 404.

Figure 6A:
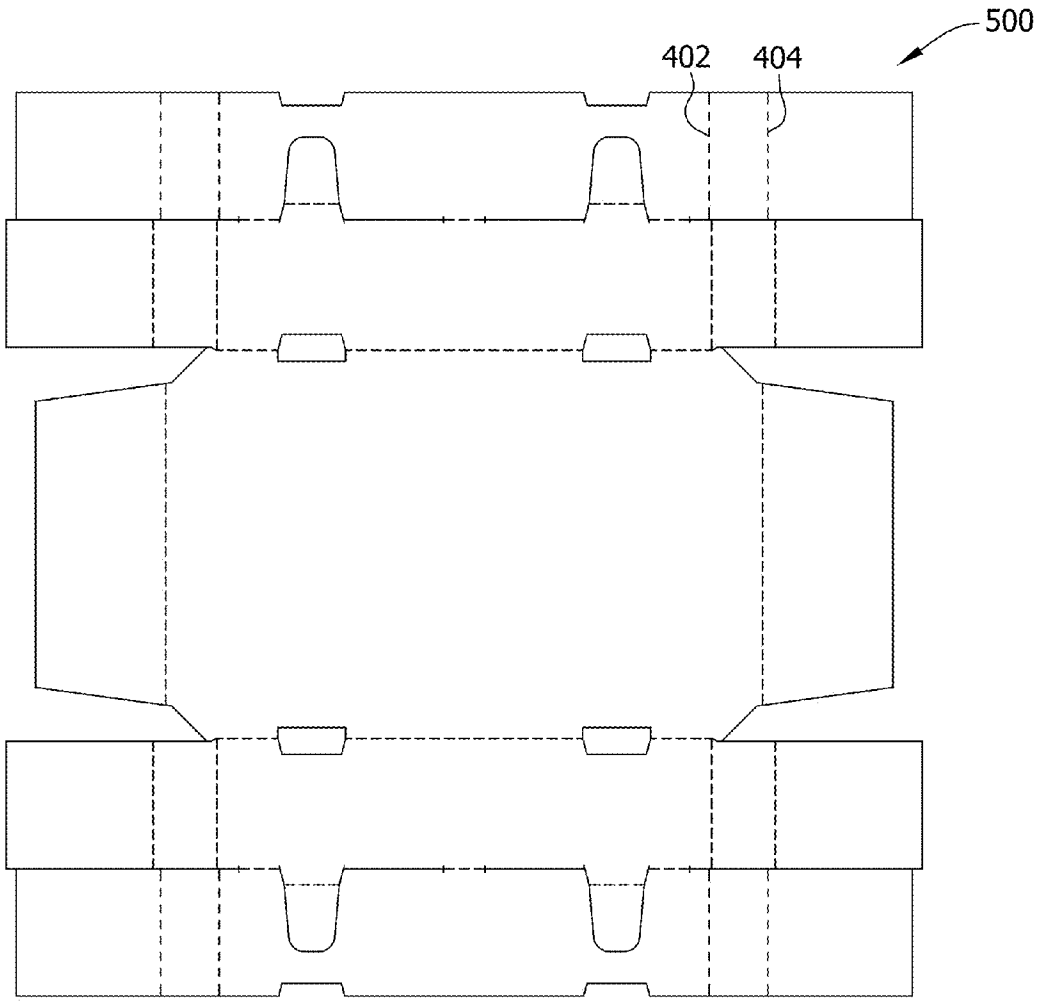
FIG. 6A is a top plan view of a fourth alternative blank of sheet material for forming a container.
Figure 6B:
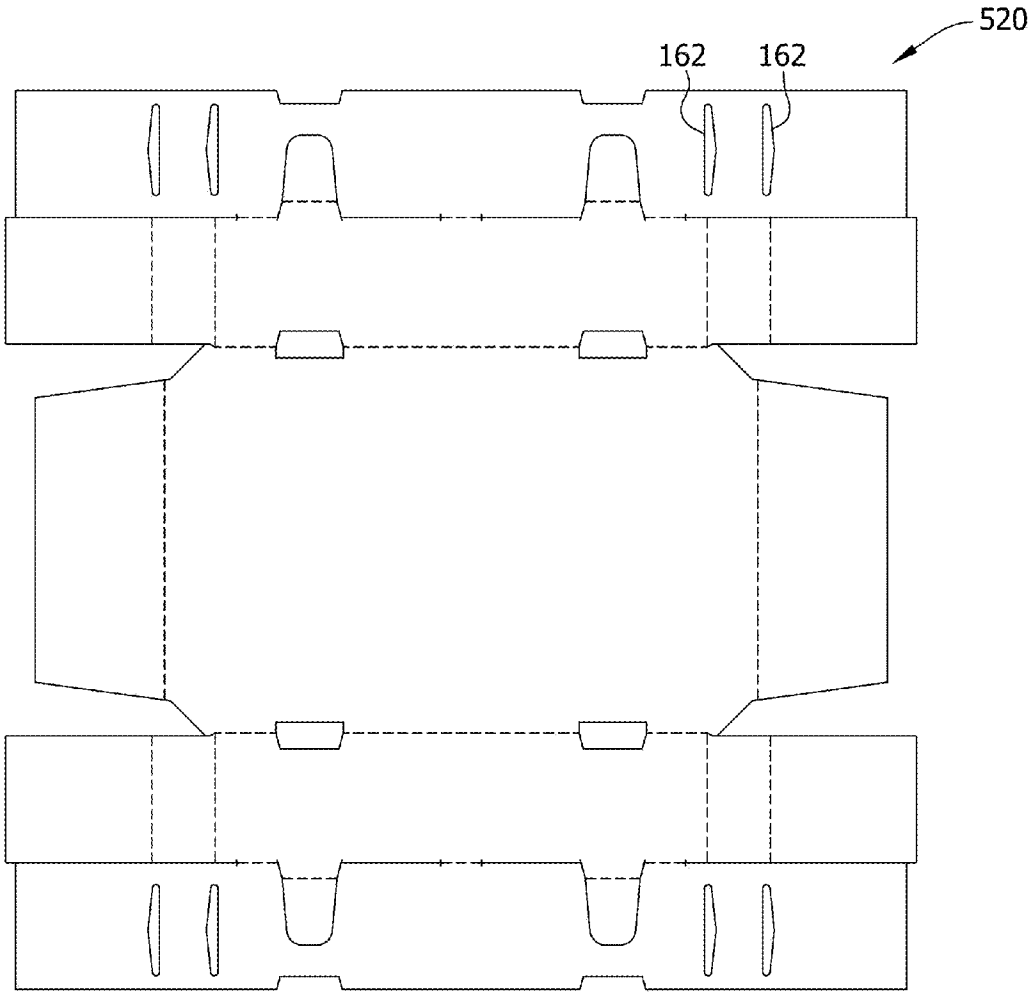
FIG. 6B is a top plan view of a fifth alternative blank of sheet material for forming a container.
Figure 7:
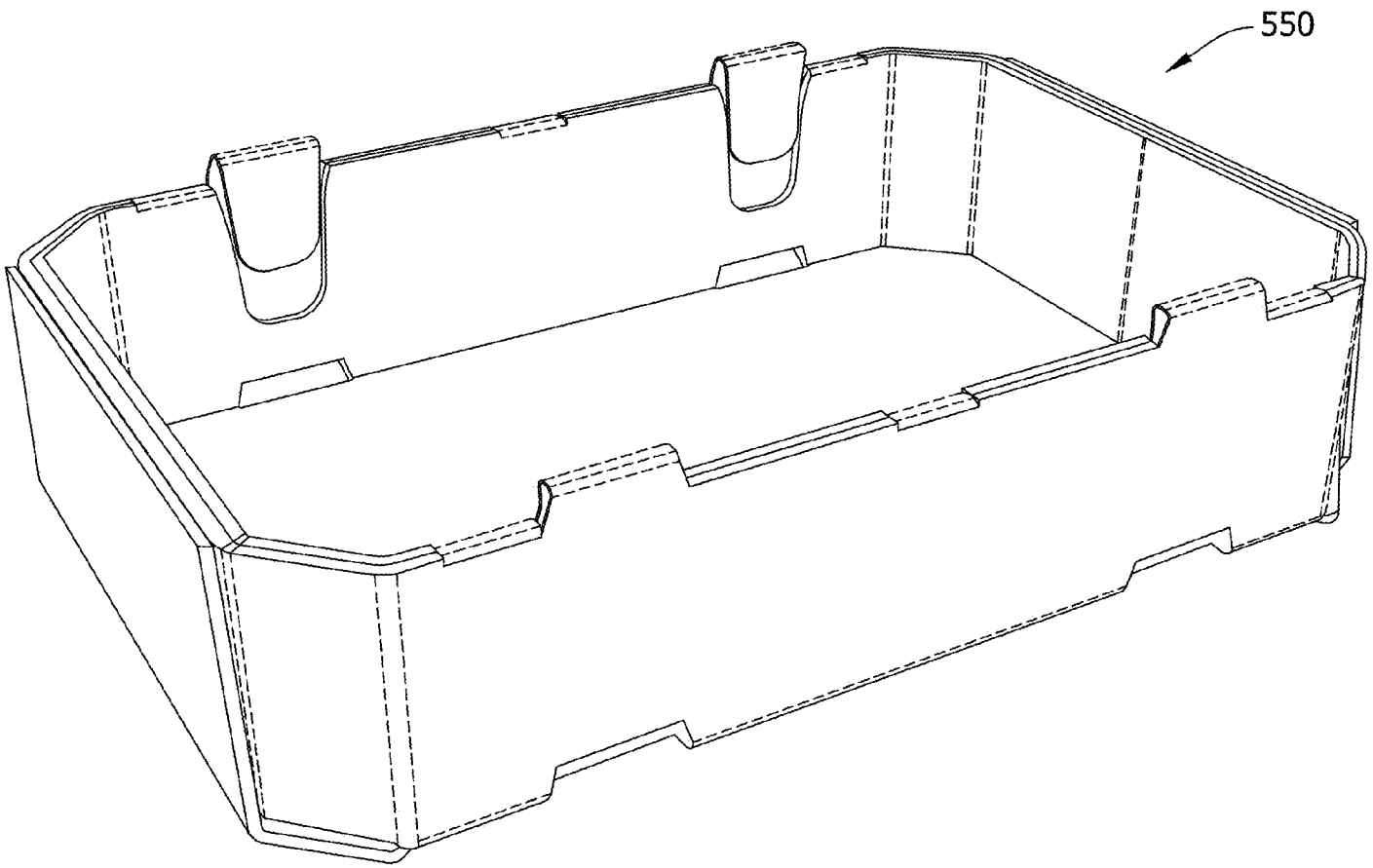

FIG. 6A is a top plan view of a fourth alternative blank 500 of sheet material for forming a container 550 (shown in FIG. 7). Blank 500 includes fold lines 402 and 404. FIG. 6B is a top plan view of a fifth alternative blank 520 of sheet material for forming a container. Blank 520 is substantially similar to blank 500, except that blank 520 includes elongated relief cutouts 162 instead of fold lines 402 and 404. FIG. 7 is a perspective view of an exemplary container 550 formed from blank 500 (shown in FIG. 6A).

Figure 8A:
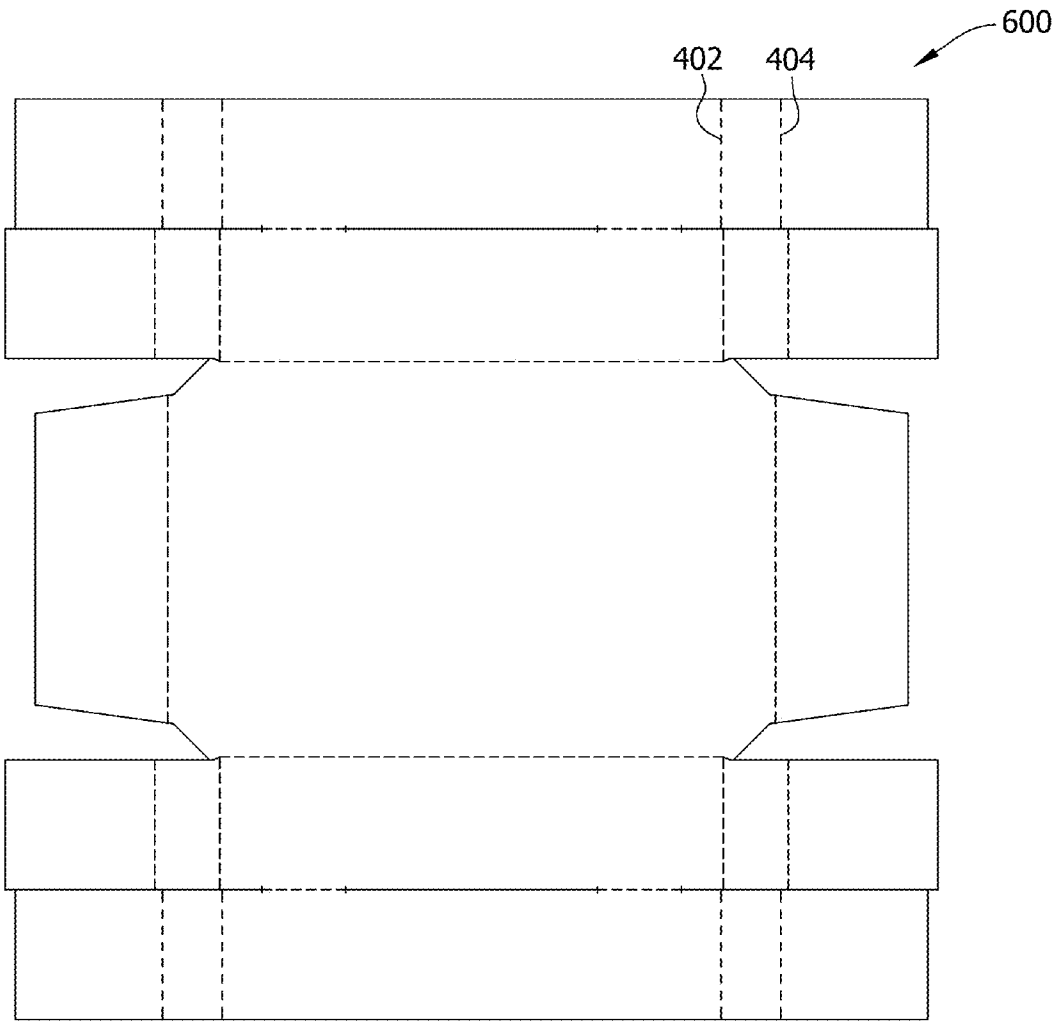
FIG. 8A is a top plan view of a sixth alternative blank of sheet material for forming a container.
Figure 8B:
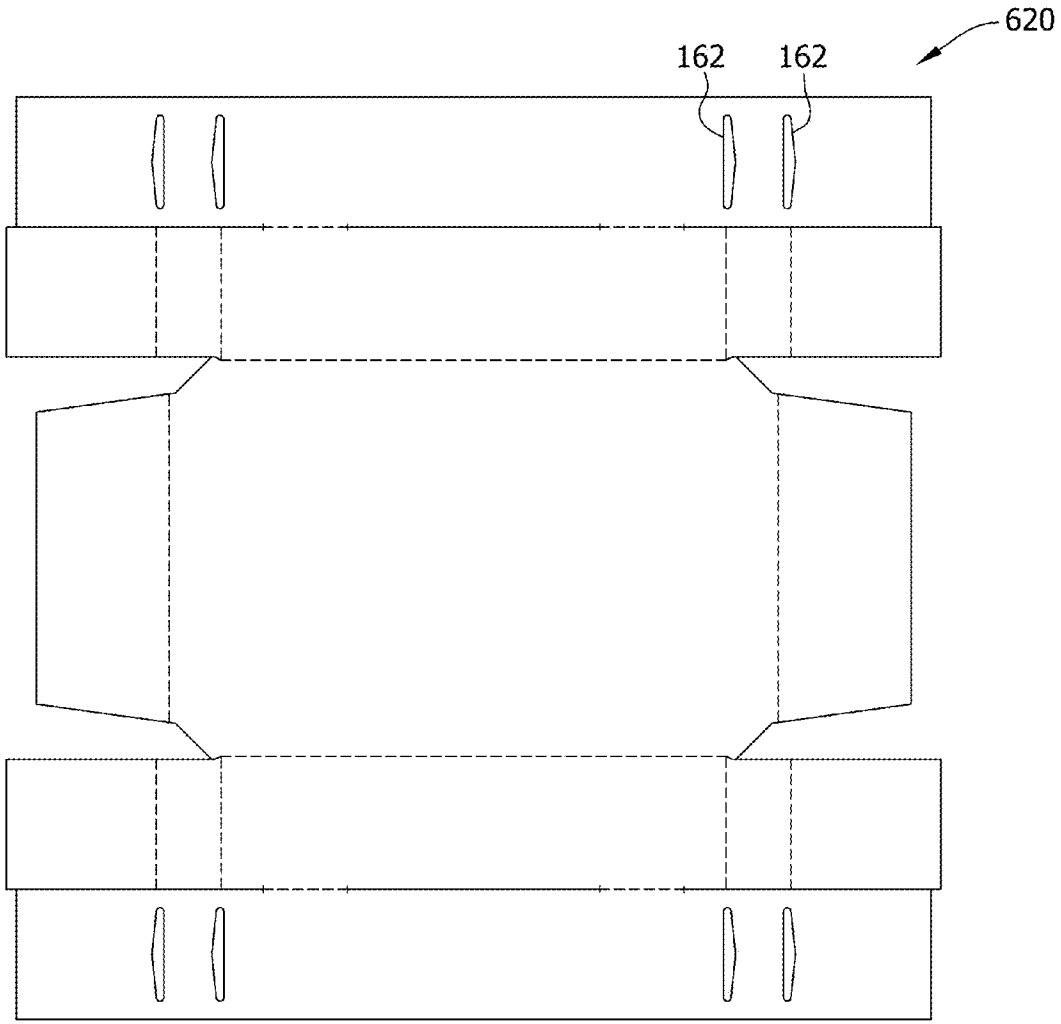
FIG. 8B is a top plan view of a seventh alternative blank of sheet material for forming a container.
Figure 9:
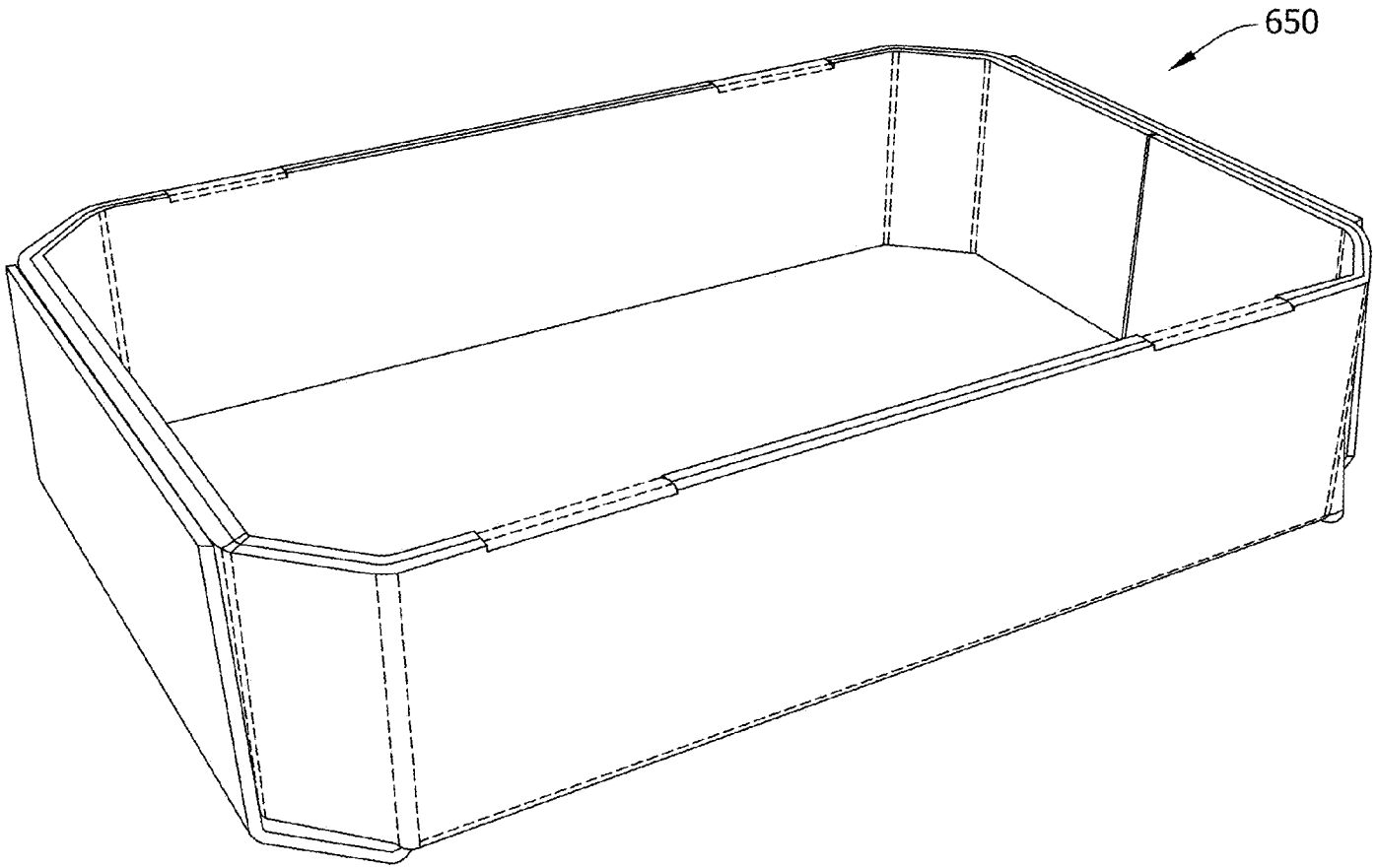

FIG. 8A is a top plan view of a sixth alternative blank 600 of sheet material for forming a container 650 (shown in FIG. 9). Blank 600 includes fold lines 402 and 404. FIG. 8B is a top plan view of a seventh alternative blank 620 of sheet material for forming a container. Blank 620 is substantially similar to blank 600, except that blank 620 includes elongated relief cutouts 162 instead of fold lines 402 and 404. FIG. 9 is a perspective view of an exemplary container 650 formed from blank 600 (shown in FIG. 8A).

Figure 10A:
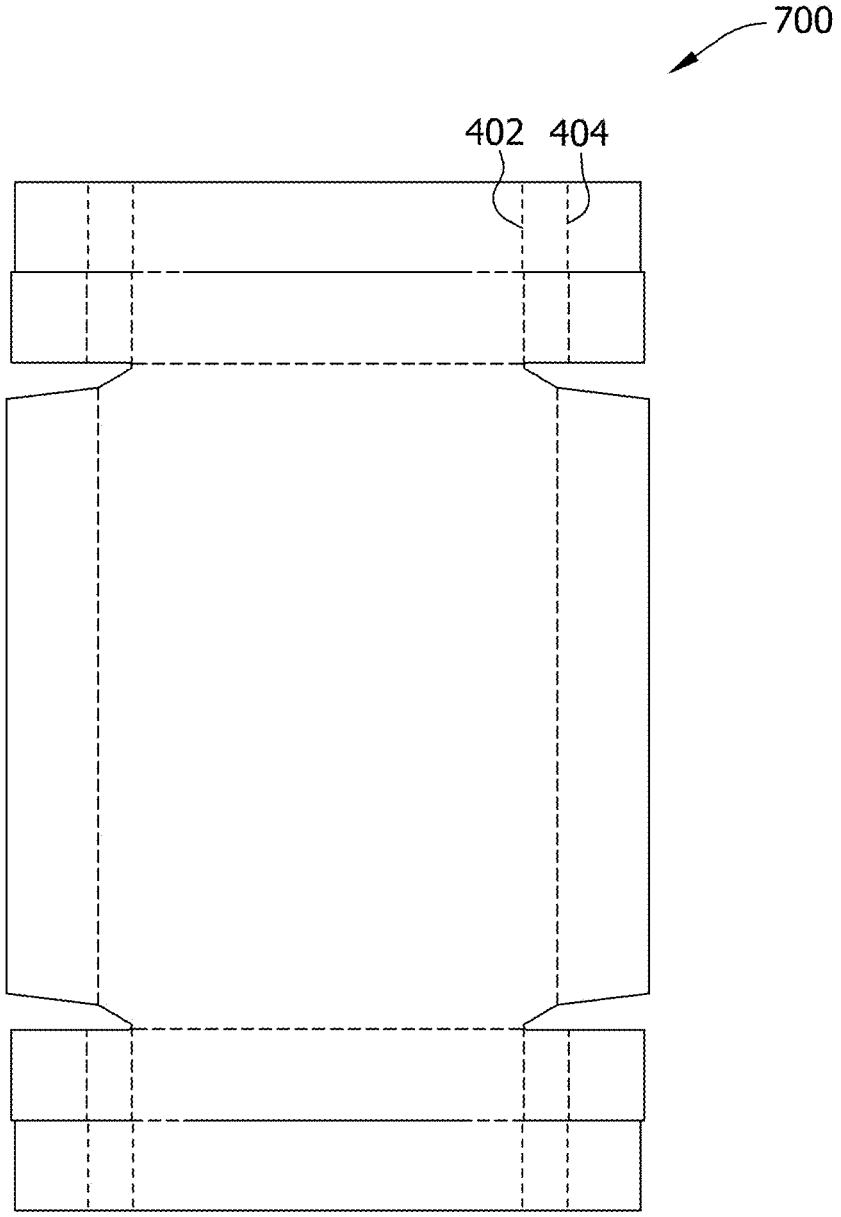
FIG. 10A is a top plan view of an eighth alternative blank of sheet material for forming a container.
Figure 10B:
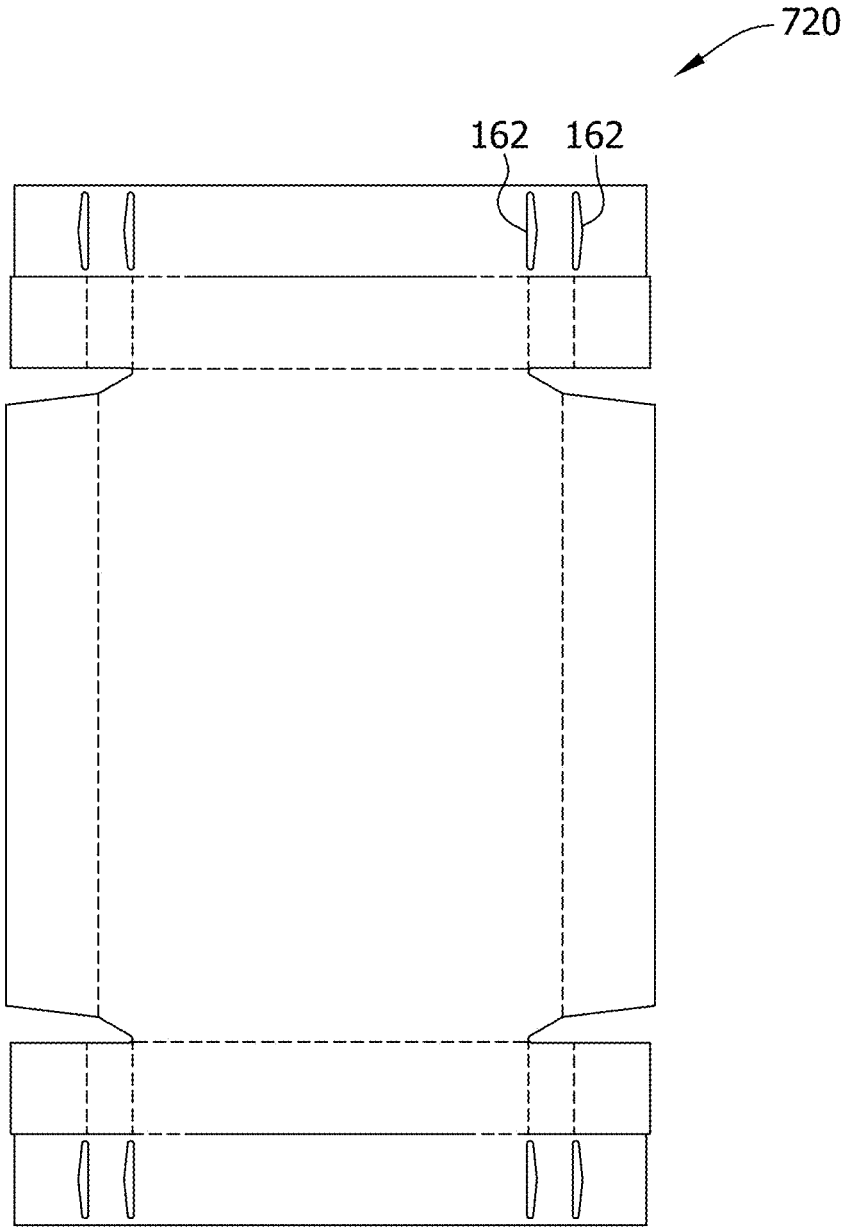
FIG. 10B is a top plan view of a ninth alternative blank of sheet material for forming a container.
Figure 11:
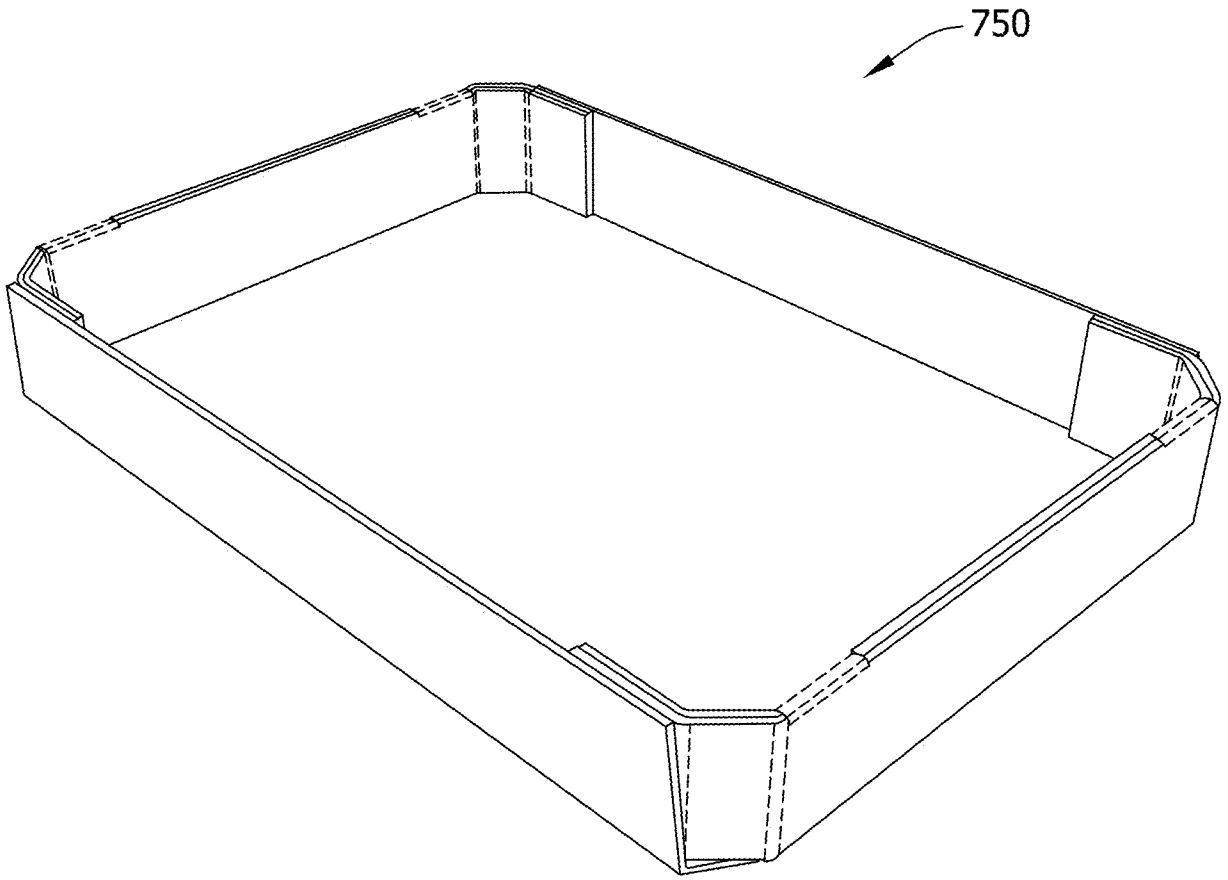

FIG. 10A is a top plan view of an eighth alternative blank 700 of sheet material for forming a container 750 (shown in FIG. 11). Blank 700 includes fold lines 402 and 404. FIG. 10B is a top plan view of a ninth alternative blank 720 of sheet material for forming a container. Blank 720 is substantially similar to blank 700, except that blank 720 includes elongated relief cutouts 162 instead of fold lines 402 and 404. FIG. 11 is a perspective view of an exemplary container 750 formed from blank 700 (shown in FIG. 10A).

Exemplary embodiments of reinforced polygonal containers and blanks for making the same are described above in detail. The containers and blanks are not limited to the specific embodiments described herein, but rather, components of the blanks and/or the containers may be utilized independently and separately from other components described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank of sheet material for forming a polygonal container, the blank comprising:

a bottom panel;

two opposing end panels, each end panel extending from an end edge of the bottom panel;

two opposing outer side panels, each outer side panel extending from a side edge of the bottom panel; and an inner side panel extending from each top edge of one outer side panel of the two outer side panels, wherein each inner side panel comprises:

a central portion;

a corner portion extending from each side of the central portion;

an inner end portion extending from a side of each of the corner portions; and a plurality of elongated relief cutouts, one elongated relief cutout of the plurality of elongated relief cutouts defined between each corner portion and the central portion and between each inner end portion and an adjacent corner portion, wherein the sheet material that extends between an end of each elongated relief cutout and a bottom edge of the inner side panel does not include a fold line extending from the relief cutout.

2. A blank in accordance with claim 1, further comprising a panel assembly extending from each side edge of each outer side panel of the two outer side panels, each panel assembly comprising:

a corner panel extending from a respective side edge of one of the outer side panels along a first fold line, the corner panel generally aligned with one of the corner portions; and an inner end panel extending from one of the corner panels along a second fold line, the inner end panel generally aligned with one of the inner end portions, the first fold line and the second fold line substantially perpendicular to a fold line between the bottom panel and a respective outer side panel.

3. A blank in accordance with claim 1, further comprising a rollover panel extending between each outer side panel of the two outer side panels and an adjacent inner side panel of the two inner side panels.

4. A blank in accordance with claim 3, further comprising a plurality of rollover relief cutouts defined in each rollover panel, each of the plurality of rollover relief cutouts aligned with one elongated relief cutout of the plurality of elongated relief cutouts.

5. A blank in accordance with claim 3, wherein a notch is defined at each end of each rollover panel, the notch formed between an inner end panel and an adjacent inner end portion.

6. A blank in accordance with claim 3, further comprising a plurality of rollover relief cutouts defined in each rollover panel, wherein each of the plurality of rollover relief cutouts is substantially circular.

7. A blank in accordance with claim 1, wherein each of the plurality of elongated relief cutouts includes an apex on a side of the relief cutout furthest from the central portion adjacent the elongated relief cutout.

8. A blank in accordance with claim 1, further comprising a pair of tabs extending from each top edge of one outer side panel of the two outer side panels.

9. A blank in accordance with claim 1, wherein the bottom panel comprises a plurality of slots configured to receive stacking tabs of a formed container.

10. A container formed from a blank of sheet material, the container comprising:

a bottom wall;

a pair of opposing end walls coupled to the bottom wall; and a pair of opposing side walls coupled to the bottom wall;

four corner walls, each corner wall of the four corner walls coupled between one of the end walls and an adjacent one of the side walls; and a plurality of elongated relief cutouts, one elongated relief cutout of the plurality of elongated relief cutouts defined between each corner wall and each end wall and between each corner wall and each side wall, wherein the sheet material that extends between an end of each elongated relief cutout and a top edge of the corresponding corner wall does not include a preformed fold line extending from the relief cutout.

11. A container in accordance with claim 10, wherein one elongated relief cutout of the plurality of elongated relief cutouts is defined between an interior surface of each corner wall and an interior surface of each end wall and between the interior surface of each corner wall and an interior surface of each side wall.

12. A container in accordance with claim 10, further comprising a plurality of rollover relief cutouts, one rollover relief cutout of the plurality of rollover relief cutouts defined between a top edge of each corner wall and a top edge of each end wall and between the top edge of each corner wall and a top edge of each side wall.

13. A container in accordance with claim 10, wherein each of the plurality of elongated relief cutouts includes an apex on a side of the relief cutout furthest from the side wall adjacent the elongated relief cutout.

14. A container in accordance with claim 10, further comprising a pair of stacking tabs extending from each side wall.

15. A container in accordance with claim 14, further comprising a plurality of slots defined in the bottom wall.

16. A container in accordance with claim 15, wherein said plurality of slots are configured to receive stacking tabs from a second container.

17. A method of forming a container from a blank of sheet material, the blank including a bottom panel, two opposing end panels, each end panel extending from an end edge of the bottom panel, two opposing outer side panels, each outer side panel extending from a side edge of the bottom panel, an inner side panel extending from each top edge of one outer side panel of the two outer side panels, each inner side panel including a central portion, a corner portion extending from each side of the central portion, an inner end portion extending from a side of each of the corner portions, and a plurality of elongated relief cutouts, one elongated relief cutout of the plurality of elongated relief cutouts defined between each corner portion and the central portion and between each inner end portion and an adjacent corner portion, wherein the sheet material that extends between an end of each elongated relief cutout and a bottom edge of the inner side panel does not include a fold line extending from the relief cutout, a corner panel extending from each side edge of one of the outer side panels along a first fold line, the corner panel generally aligned with one of the corner portions, and an inner end panel extending from one of the corner panels along a second fold line, the inner end panel generally aligned with one of the inner end portions, the first fold line and the second fold line substantially perpendicular to a fold line between the bottom panel and a respective outer side panel, the method comprising:

rotating the outer side panels towards the bottom panel such that the outer side panels are substantially perpendicular to the bottom panel;

rotating the inner side panels towards the bottom panel such that the inner side panels are substantially parallel to the outer side panels, wherein the central portions of each inner side panel and the outer side panels form a pair of opposing side walls;

rotating the corner panels along the first fold lines and rotating the corner portions of the inner side panels at elongated relief cutouts aligned with the first fold lines to form four corner walls;

rotating the inner end panels along the second fold lines and rotating the inner end portions at elongated relief cutouts aligned with the second fold lines such that each inner end panel is in a face-to-face relationship with a respective inner end portion to form an inner end assembly;

rotating the end panels toward the bottom panel such that each end panel is substantially perpendicular to the bottom panel and positioned adjacent a pair of the inner end assemblies to facilitate forming one of a pair of opposing end walls.

18. A method in accordance with claim 17, further comprising folding a pair of tabs extending from each outer side panel toward the bottom panel to form a pair of stacking tabs on the opposing side walls.

19. A method in accordance with claim 17, wherein rotating the corner portions of the inner side panels at elongated relief cutouts aligned with the first fold lines comprises rotating the corner portions at elongated relief cutouts each having an apex on a side of the relief cutout furthest from the central portion adjacent the elongated relief cutout.

20. A method in accordance with claim 17, wherein rotating the inner end portions of the inner side panels at elongated relief cutouts aligned with the second fold lines comprises rotating the corner portions at elongated relief cutouts each having an apex on a side of the relief cutout furthest from the central portion adjacent the elongated relief cutout.

21. A blank of sheet material for forming a polygonal container, the blank comprising:

a bottom panel;

two opposing end panels, each end panel extending from an end edge of the bottom panel;

two opposing outer side panels, each outer side panel extending from a side edge of the bottom panel;

an inner side panel extending from each top edge of one outer side panel of the two outer side panels, wherein each inner side panel comprises:

a central portion;

a corner portion extending from each side of the central portion;

an inner end portion extending from a side of each of the corner portions; and a plurality of elongated relief cutouts, one elongated relief cutout of the plurality of elongated relief cutouts defined between each corner portion and the central portion and between each inner end portion and an adjacent corner portion; and a rollover panel extending between each outer side panel of the two outer side panels and an adjacent inner side panel of the two inner side panels, a plurality of rollover relief cutouts defined in each rollover panel, wherein each of the plurality of rollover relief cutouts is substantially circular.

* * * * *